US006244102B1

(12) United States Patent
Novak

(10) Patent No.: US 6,244,102 B1
(45) Date of Patent: Jun. 12, 2001

(54) METHOD AND SYSTEM FOR EXAMINATION AND OPTIMAL COMPACTION OF SOIL ENBANKMENTS

(75) Inventor: Semion Novak, Kiryat Shmona (IL)

(73) Assignee: Dynasens Ltd., Kiryat Shmona (IL)

( * ) Notice: Subject to any disclaimer, the term of this patent is extended or adjusted under 35 U.S.C. 154(b) by 0 days.

(21) Appl. No.: 09/593,666

(22) Filed: Jun. 14, 2000

Related U.S. Application Data

(63) Continuation-in-part of application No. 09/157,108, filed on Sep. 18, 1998, now abandoned.

(51) Int. Cl.[7] ..... G01N 3/00; G01N 3/48; G01N 33/24; G01M 7/90; G01B 5/00

(52) U.S. Cl. ..... 73/84; 73/78; 73/81; 73/784; 73/594

(58) Field of Search ..... 73/84, 78, 81, 73/594, 784, 152

(56) References Cited

U.S. PATENT DOCUMENTS

| | | | | |
|---|---|---|---|---|
| 3,323,352 | * | 6/1967 | Branson | 73/78 |
| 3,778,177 | * | 12/1973 | Haker et al. | 404/117 |
| 4,348,901 | * | 9/1982 | Vural et al. | 73/594 |
| 5,105,650 | | 4/1992 | Atkinson et al. | 73/12 |
| 5,337,601 | * | 8/1994 | Becker et al. | 73/155 |
| 5,426,972 | * | 6/1995 | Heirtzler et al. | 73/84 |
| 5,952,561 | * | 9/1999 | Jaselskis et al. | 73/78 |

FOREIGN PATENT DOCUMENTS

| | | | |
|---|---|---|---|
| 717623 | 2/1980 | (SU) | 73/84 |
| 763506 | 9/1980 | (SU) | 73/84 |

* cited by examiner

*Primary Examiner*—Hezron Williams
*Assistant Examiner*—Dennis Loo
(74) *Attorney, Agent, or Firm*—Browdy & Neimark

(57) ABSTRACT

A method for evaluating the compaction, by means of a vibrator compaction device having mass $M_{vib}$ and a bearing area F, of a preselected soil layer, for which a predetermined degree of compaction is desired, at a preselected depth l in a soil base having at least one layer disposed between an exterior upper surface and a hard bottom layer, thereby defining a vibrator-soil-base system, which includes the steps of: evaluating a desired volumetric mass $\gamma_{st}$ of the preselected soil layer corresponding to the desired degree of compaction, which may be performed by measurement or by calculation using standard soil data; calculating a mass per unit area $m_{soil}$ of the preselected soil layer as a function of the desired volumetric mass; calculating the effective vibrating mass M of the vibrator-soil-base system as a function of the mass per unit area of the preselected soil layer and the mass of the vibrator; determining the natural oscillation frequency $\omega_o$ of the vibrator-soil-base system when the preselected soil layer is at the desired degree of compaction as a function of its effective mass; measuring the forced oscillation frequency $\omega_{res}$ of the vibrator-soil-base system for frequencies close to the natural oscillation frequency $\omega_o$; deriving the volumetric mass $\gamma$ of the preselected soil layer as a function of the desired volumetric mass of the preselected soil layer and of the natural oscillation frequency and the forced oscillation frequency of the vibrator-soil-base system; and determining compaction degree K of the compacted preselected soil layer.

9 Claims, 5 Drawing Sheets

METHOD AND SYSTEM FOR EXAMINATION AND OPTIMAL COMPACTION OF SOIL ENBANKMENTS

RELATED APPLICATIONS

The present application is a continuation-in-part of application Ser. No. 09/157,108, filed Sep. 18, 1998, now abandoned, the entire contents being hereby incorporated by reference.

FIELD OF THE INVENTION

This invention relates to a process and a system for examination and optimal compaction of single- or multi-layered soil embankments before constructing roads, railways and the like.

BACKGROUND OF THE INVENTION

A number of systems are known in the prior art which are capable of compacting soil during construction of automobile roads, railroads, airfields, etc. The proper compaction of the soil base is intended to ensure that the mentioned constructions will reliably withstand loads of various kinds, including non-uniform, non-periodic and extremely high surface pressures. Methods and systems for evaluating soil compaction are also known, but generally, they are only capable of evaluating the compaction of an uppermost layer in a soil base. Further, even for the uppermost layer in a soil base, these methods are not capable of deriving both the compaction and the thickness of the single layer. Where these methods and systems work with compaction machines, they also cannot control the depth at which the compaction will take place.

U.S. Pat. No. 5,426,972 describes a method and an apparatus for determining whether soil is satisfactorily compacted. An operator delivers impact energy to the soil, and the amount of impact energy transmitted through the soil is repeatedly sensed and stored. A modeling formula, which approximates the variation of the stored amounts of impact energy, is used to generate current and target values for the level of compaction; if the current value equals or exceeds the target value, the soil is considered to be satisfactorily compacted. The target value is considered to be one common parameter of the soil regardless whether it comprises many different layers.

SU 717623 teaches a method of controlling the degree of compaction of soil embankments by transmitting into the embankment a vibratory signal with an adjustable frequency close to its calculated resonant frequency and estimating the compaction degree based on the real resonant frequency of the soil.

Commercially available modern systems for soil compaction are manufactured by a widely known German company BOMAG and a Swedish company GEODYNAMIK and are adapted for continuously measuring in situ the degree of compaction of a layer currently undergoing treatment, namely detecting the condition of the upper layer of the construction. Such systems are suitable for successively (i.e. layer by layer) forming the multi-layered base for a road or the like.

However, if any multi-layered base already exists, no means for examining the compaction degree thereof are available in these systems. It should be emphasized that constructing a road or the like on a non-explored and/or improperly compacted base is likely to result in serious problems during further use of the road.

An approach to the compaction of existing multi-layered soils is suggested in SU 763506, which is incorporated herein by reference. According to the approach described therein, different layers of any existing soil base which are exposed to vibrations created by any particular compaction instrument, can be represented as a number of differential equations reflecting free oscillation of a mechanical system disposed between the compaction instrument and the immovable bottom of the base, wherein each of the equations has its own static and dynamic parameters reflecting the layer's characteristics. The method suggests generating and solving a system of equations for a particular multi-layer base, for determining resonant frequencies of different layers of the base, and further performing the compaction of the base using the minimal resonant frequency which has been determined for the system, thus obtaining the maximal deformation and compaction of the soil.

However, it has been found and proven by the inventor that compacting each and every layer of the base maximally may not always produce optimal compaction results.

SUMMARY OF THE INVENTION

It is therefore an object of the present invention to provide a method and an appropriate system for effective soil compaction having improved performance over hitherto-proposed systems. Other aspects of the invention concern a method of computerized examination of the existing soil base and a system for accomplishing the mentioned methods. A further object of the present invention is to provide a method for evaluating the compaction of a soil base using a vibrator compaction device.

In the description, the term "layer" is used in the meaning of any kind of geological or artificially created massive body of soil, rock, pebble, limestone, sand, clay, waste (compacted or non-compacted), etc. which is generally horizontally disposed on top of an adjacent layer in an existing or artificially created base or embankment. The term "hard bottom layer" should be understood as an immovable ground layer, such as a rock bed.

There is thus provided, in accordance with an additional preferred embodiment of the present invention, a method for evaluating the compaction, by means of a vibrator compaction device having mass $M_{vib}$ and a bearing area F, of a preselected soil layer, for which a predetermined degree of compaction is desired, at a preselected depth l in a soil base having at least one layer disposed between an exterior upper surface and a hard bottom layer, thereby defining a vibrator-soil-base system, which includes the steps of:

evaluating a desired volumetric mass $\gamma_{st}$ of the preselected soil layer corresponding to the desired degree of compaction, which may be performed by measurement or by calculation using standard soil data;

calculating a mass per unit area $m_{soil}$ of the preselected soil layer as a function of the desired volumetric mass, using the formula:

$$m_{soil}=\gamma_{st}*l;$$

calculating the effective vibrating mass M of the vibrator-soil-base system as a function of the mass per unit area of the preselected soil layer and the mass of the vibrator, using the formula:

$$M=M_{vib}+\tfrac{1}{3}(m_{soil}*F);$$

determining the natural oscillation frequency $\omega_o$ of the vibrator-soil-base system when the preselected soil layer is at the desired degree of compaction as a function of its effective mass, using the formula:

$$\omega_o=\sqrt{(C/M)}.$$

wherein C is the stiffness coefficient of the soil of the preselected soil layer;

measuring the forced oscillation frequency $\omega_{res}$ of the vibrator-soil-base system for frequencies close to the natural oscillation frequency $\omega_o$;

deriving the volumetric mass $\gamma$ of the preselected soil layer as a function of the desired volumetric mass of the preselected soil layer and of the natural oscillation frequency and the forced oscillation frequency of the vibrator-soil-base system, using the formula:

$$\gamma=\gamma_{st}*(\omega_{res}/\omega_o)^2;\text{ and}$$

determining compaction degree K of the compacted preselected soil layer.

The step of determining the compaction degree K of the compacted preselected soil layer may be performed using the formula:

$$K=\gamma/\gamma_{st};$$

or alternatively, if suitable measurements have been taken and the required parameters are known, using the formula:

$$K=(\omega_{res}/\omega_o)^2.$$

Operation of the dynamic and the technological optimization models will be further explained in the specific description of the preferred embodiments.

BRIEF DESCRIPTION OF THE DRAWINGS

In order to understand the invention and to see how it may be carried out in practice, a preferred embodiment will now be described, by way of non-limiting example only, with reference to the accompanying drawings, in which:

FIG. 1*a* is a schematic cross-sectional view of an existing multi-layer soil base to be compacted by compaction equipment before starting construction of a road or the like.

DETAILED DESCRIPTION OF THE INVENTION

Figure 1A:
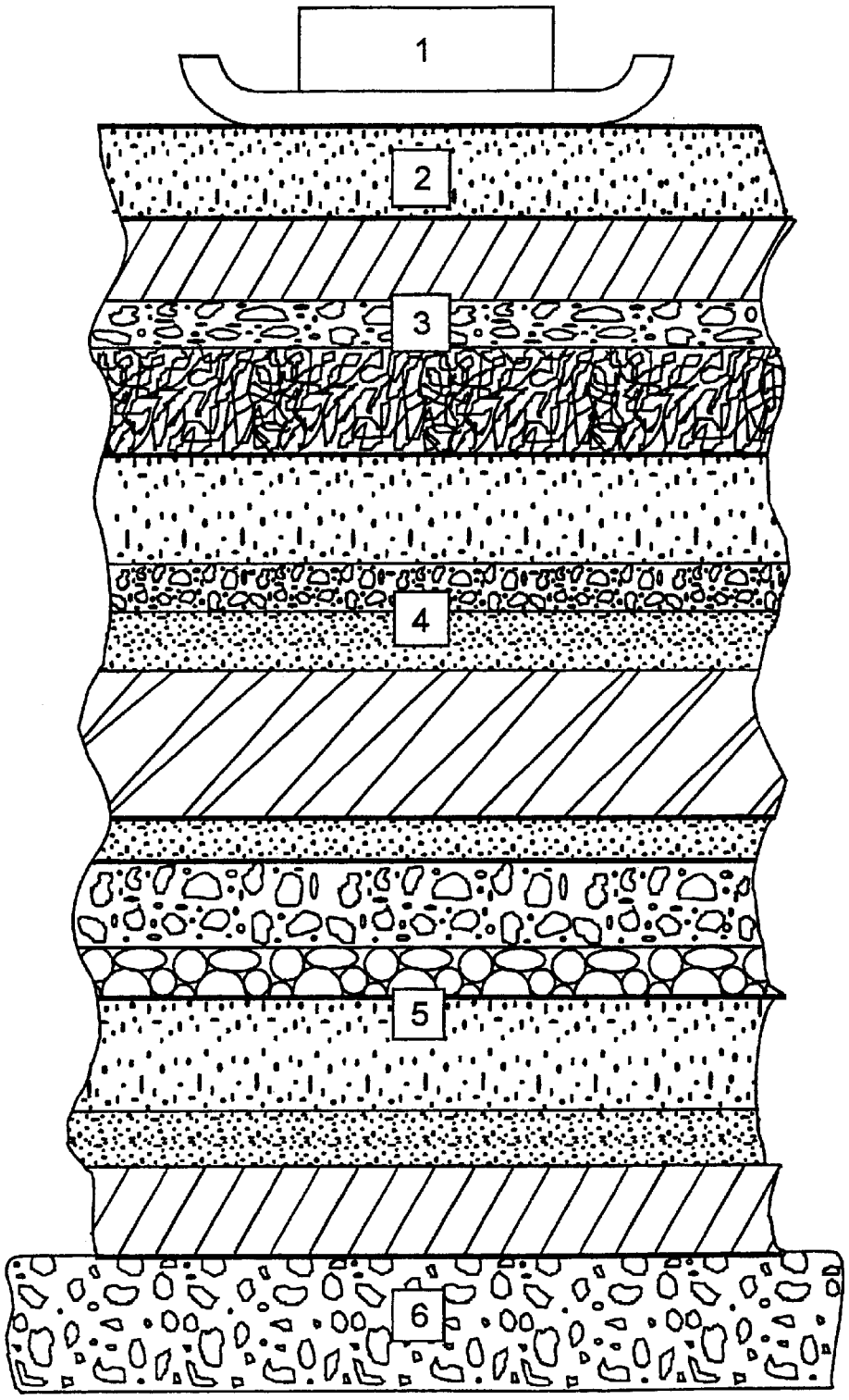
Figure 1B:
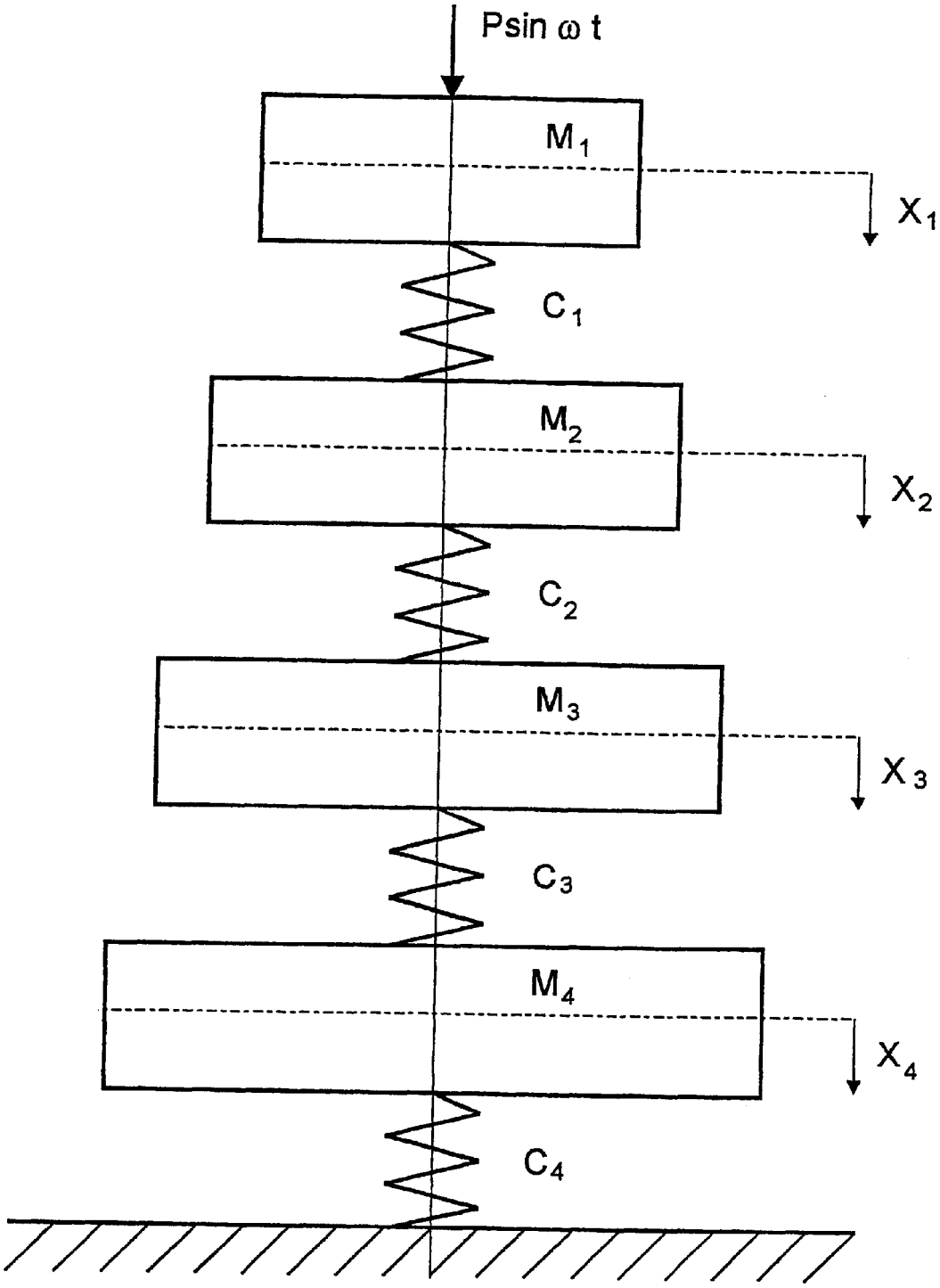
FIG. 1*b* schematically illustrates a mechanical system with elastic, dissipative and mass properties being a dynamic simulation of the multi-layer soil base shown in FIG. 1*a*.

FIG. 1*a* illustrates a soil core (base) to be compacted, while FIG. 1*b* shows its dynamic model. The soil base consists of an embankment 2 (e.g., an additional soil layer of a railroad bed), (a fill) placed directly on sedimentary layers 3, below which there are a highly weathered soil layers 4, scarcely weathered soil layers 5, and a rock bed 6. Compaction is performed with a vibrator 1.

Data on dynamic (i.e. elastic, mass, and dissipative) properties of the soil base can be obtained for each of the soil layers down the rock bed from a preliminary geological exploration, as well as field and laboratory tests done before the beginning of the work. For example, the elastic properties of the soil are equivalent to elastic compression factors; mass properties are defined by volumetric masses of the soil layer, and dissipative properties can be inferred by any known technique, such as from a vibrogram of damped vibrations.

Based on static and dynamic parameters of the vibrator (its weight, frequency variation limits, disturbing force, power), natural frequency spectrum (i.e. resonance frequencies) of the dynamic system "vibrator—elastic base" can be obtained. Vibration amplitudes of the vibrator and mass displacements in different layers of the soil base can be determined by solving a set of differential equations for forced vibrations at a specific disturbing force of the vibrator and specific vibration frequencies, provided that the forced vibration frequency approaches to one or another natural vibration frequency of the system.

FIG. 1*b* shows a dynamic system having mass and elastic properties, which simulates the "vibrator—soil base" system illustrated in FIG. 1*a*. Dissipative properties are neglected in this specific model. In the figure, $M_1$ to $M_4$ designate mass properties of the vibrator 1 and three generalized layers between the vibrator 1 and the rock bed 6. Since soil layers 2 and 3 shown in FIG. 1*a* have substantially similar dynamic parameters and behavior, they are combined in one block $M_2$ in this simulation. "Springs" $C_1$ to $C_4$ designate elastic properties of each pair of the adjacent members of the system. Arrows $X_1$ to $X_4$ indicate center displacements of masses $M_1$ to $M_4$. Free vibrations of the system can be represented by the following differential equations:

$$\begin{aligned}
&M_1\frac{d^2X_1}{dt^2}+C_1(X_1-X_2)=O\\
&M_2\frac{d^2X_2}{dt^2}-C_1(X_1-X_2)+C_2(X_2-X_3)=O\\
&M_3\frac{d^2X_3}{dt^2}-C_2(X_2-X_3)+C_3(X_3-X_4)=O\\
&M_4\frac{d^2X_4}{dt^2}-C_3(X_3-X_4)+C_4X_4=O
\end{aligned}\tag{3}$$

Upon solving the system of the equations by a known technique (as described, for example, in SU 763506), a number of resonance frequencies of the system can be obtained.

Entering particular physical-mathematical characteristics into the mathematical model enables motion parameters of the working member and of different soil layers to be computed and allows appropriate corrections to the working member motion to be entered.

On the other hand, monitoring the amplitude and frequency of the vibration of the soil layer in contact with the vibro-compactor surface enables estimation of dynamic stress in any region of the soil under compaction and prediction of its compaction rate by comparing with tabulated values, thus allowing proper corrections to be made.

It will be shown now, how dynamic parameters of the system of FIG. 1*a* can be evaluated with account for specific values of a disturbing force P sin $\omega t$ and modulus of dissipation $\gamma$. The dissipation modulus (or the so-called internal friction factor) is given by $\gamma=\delta/\pi$, where $\delta$ is a logarithmic decrement of vibration.

For the case under study, differential equations of vibrating mass motion with account for plastic resistance can be represented in the following form (4):

$$M_1\frac{d^2x_1}{dt^2} = -C_1(x_1 - x_2)(1 + i\gamma)Pe^{i\omega t}$$

$$M_2\frac{d^2x_2}{dt^2} = C_1(x_1 - x_2)(1 + i\gamma) - C_2(x_2 - x_3)(1 + i\gamma)$$

$$M_3\frac{d^2x_3}{dt^2} = C_2(x_2 - x_3)(1 + i\gamma) - C_3x_3(1 + i\gamma)$$

We seek the partial solutions of the set of equations (4) in the form:

$$x_1=a_1e^{i\omega t} \quad (5)$$

$$x_2=a_2e$$

$$x_3=a_3e^{i\omega t}$$

In equations (4) and (5):

$X_1$; $X_2$; $X_3$ are the complex values of displacements and $a_1$; $a_2$; $a_3$ are the complex values of amplitudes of vibration e is the base of natural logarithms;

i is the imaginary number=$\sqrt{-1}$ (forming the base of complex numbers).

After proper manipulations, the solution of the set (5) takes the following general form:.

$$X_1=A_1 \cos[\omega t+(\alpha-\beta)] \quad (6)$$

$$X_2=A_2 \cos[\omega t+(\alpha_1-\beta)] \quad (7)$$

$$X_3=A_3 \cos[\omega t+\alpha_2-\beta)] \quad (8)$$

The full solution is not given because of its awkwardness.

Solutions of equations (6), (7) and (8) define the values of vibration amplitudes $A_1$, $A_2$, $A_3$, the phase shift angles $(\alpha-\beta)$; $(\alpha_1-\beta)$; $(\alpha_2-\beta)$ at specific values of the system parameters, of the disturbing force and dissipation modulus. Signs (+ or −) of the obtained amplitude values and the angles enable the choice of a suitable phase regime for compacting each specific layer of the soil base. In other words, the above equations comprise information for selecting the regime when two layers adjoining a layer undergoing the compaction vibrate with phases differing by 180° from that of the layer to be compacted.

The obtained results are used as follows: the known values of P and ω and, say, the obtained value of amplitude $A_2$ of the second layer are introduced in the technological optimization model for obtaining an optimal combination C of parameters suitable for effective compaction of the second layer. Optimal combinations for compaction of other layers are found in the similar way. If the optimization model is unable to suggest a suitable combination based on the mentioned input, the disturbing force P or the frequency ω can be adjusted.

Figure 2:
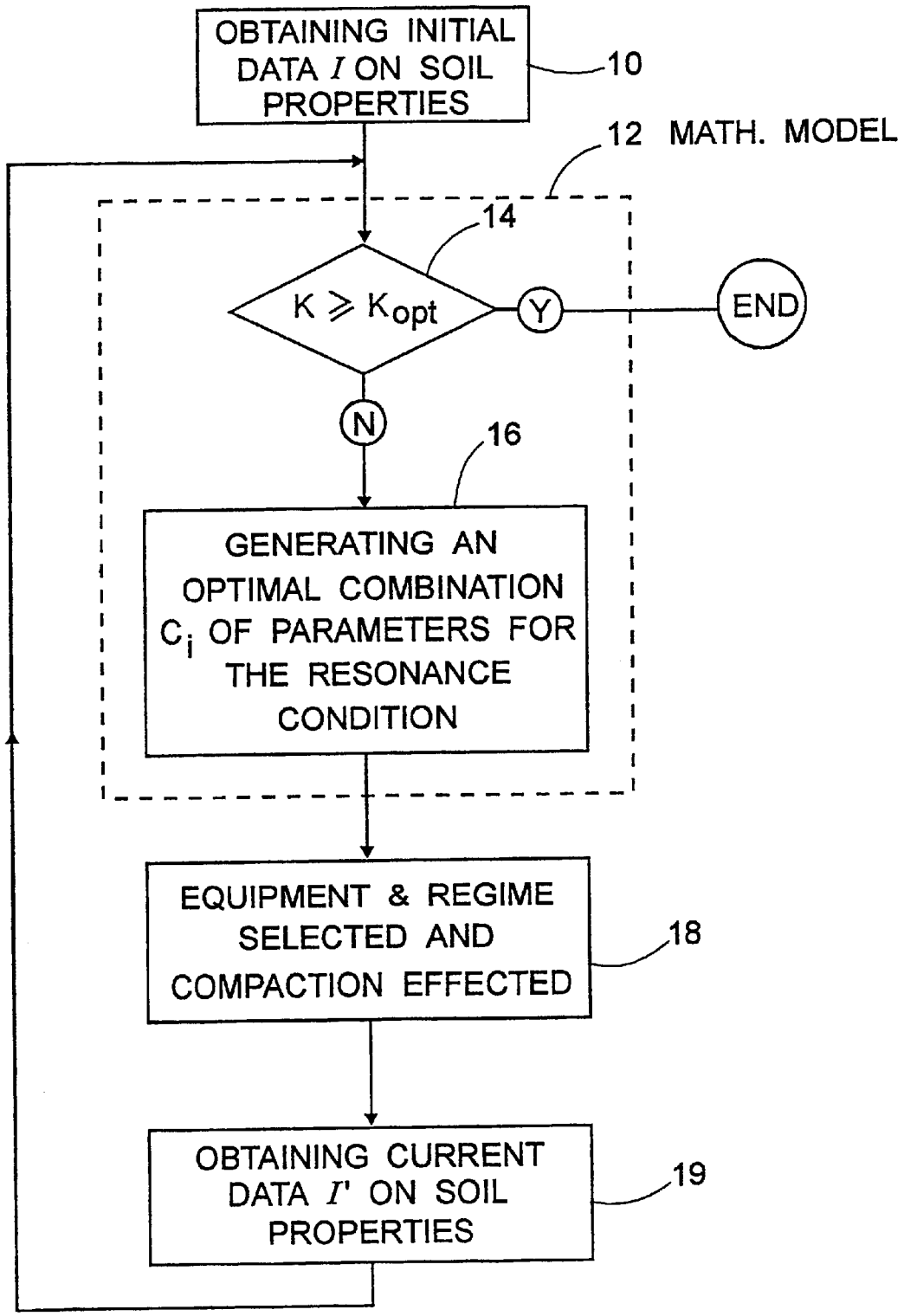
FIG. 2 is a schematic algorithm of the inventive method for compaction of a soil base.

FIG. 2 shows a schematic block-diagram of the method for optimal soil compaction according to the invention. Initial data on the soil properties is obtained (block 10 of the algorithm) according to any of the above-described techniques. From block 10 the information is entered into a mathematical model generally marked 12 where it is processed. If the compaction degree of a particular layer of a multi-layered base (or the compaction degree of a single-layer base) is not lower than the optimal degree $K_{opt}$, pre-set for this layer (block 14), compaction is not required. If it is lower, the mathematical model will generate at least one optimal combination C of parameters of equipment and technological process suitable for compacting this layer up to the optimal compaction degree in the resonance condition or close to it (block 16). According to the obtained optimal combination, a specific piece of compaction equipment is selected and adjusted, and the compaction process is carried out in a recommended regime (block 18). Simultaneously, or after a session of the compaction, current data on the soil properties is obtained (block 19) and fed back to the mathematical model for evaluation whether the optimal compaction degree was achieved. If not, a new optimal combination C will be generated until the particular layer is compacted optimally. Then, if the multi-layered base is considered, the process can be repeated for another layer thereof.

Figure 3:
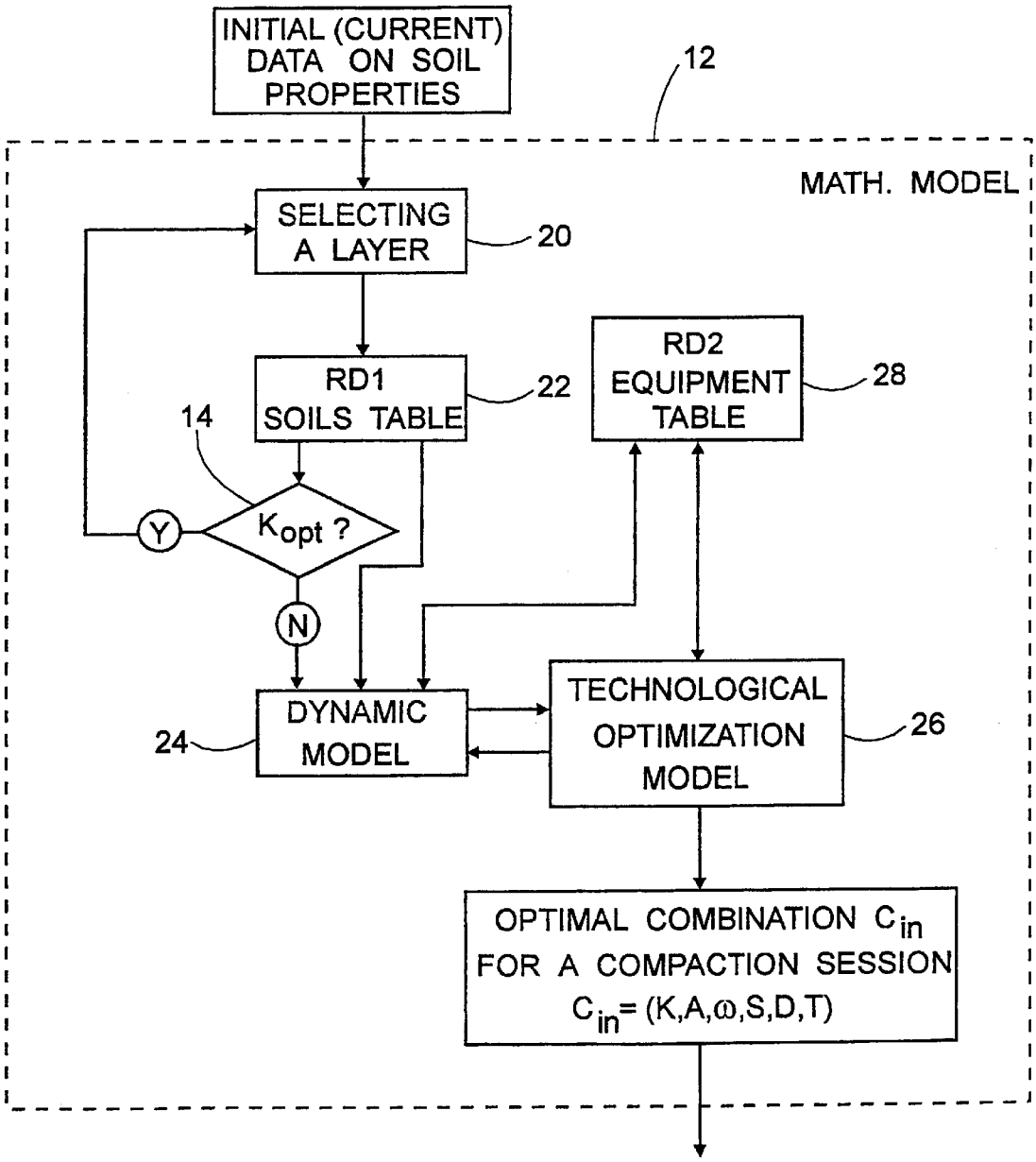
FIG. 3 is a block-diagram schematically illustrating structure of the mathematical model indicated in FIG. 2.

FIG. 3 explains in more detail how the mathematical model 12 can be organized. For example, after initial or current data on the soil properties is obtained, a particular layer thereof is selected for being compacted first. Usually, it is a layer having the minimal resonant frequency. The initial data on the selected layer is entered in a reference data table RD1 (block 22) representative of dynamic properties of any known soil materials, wherein the dynamic properties of each soil material are presented in groups being associated with maximal, optimal and minimal compaction degrees for this material. That enables the real compaction degree of the layer to be compared with the tabulated compaction degree (block 14) so that, if they are sufficiently close, another layer may be chosen to be compacted. If the compaction degree is lower than the optimal, the data is further processed by the interacting dynamic model (block 24) and technological optimization model (block 26) with the aid of a reference data table RD2 (block 28) comprising information on static S and dynamic D parameters of different compaction machines. The dynamic model, based on the initial or current input obtained from RD1 and provisional data from RD2, is capable of determining an amplitude A and frequency ω of the working member of a provisional compaction equipment, the frequency being close to one of the resonance frequencies of the system, corresponding to the selected soil layer. In turn, the technological optimization model generates a number of optimal combinations C where the optimal compaction degree K is supposed to be associated with the amplitude A and frequency ω, as well as with specific static S and dynamic D parameters of a specific compaction machine and with specific characteristics T of the technological process. The process of discovering such combinations may be iterative, which is shown by two-directional arrows in the drawing.

Figure 4:
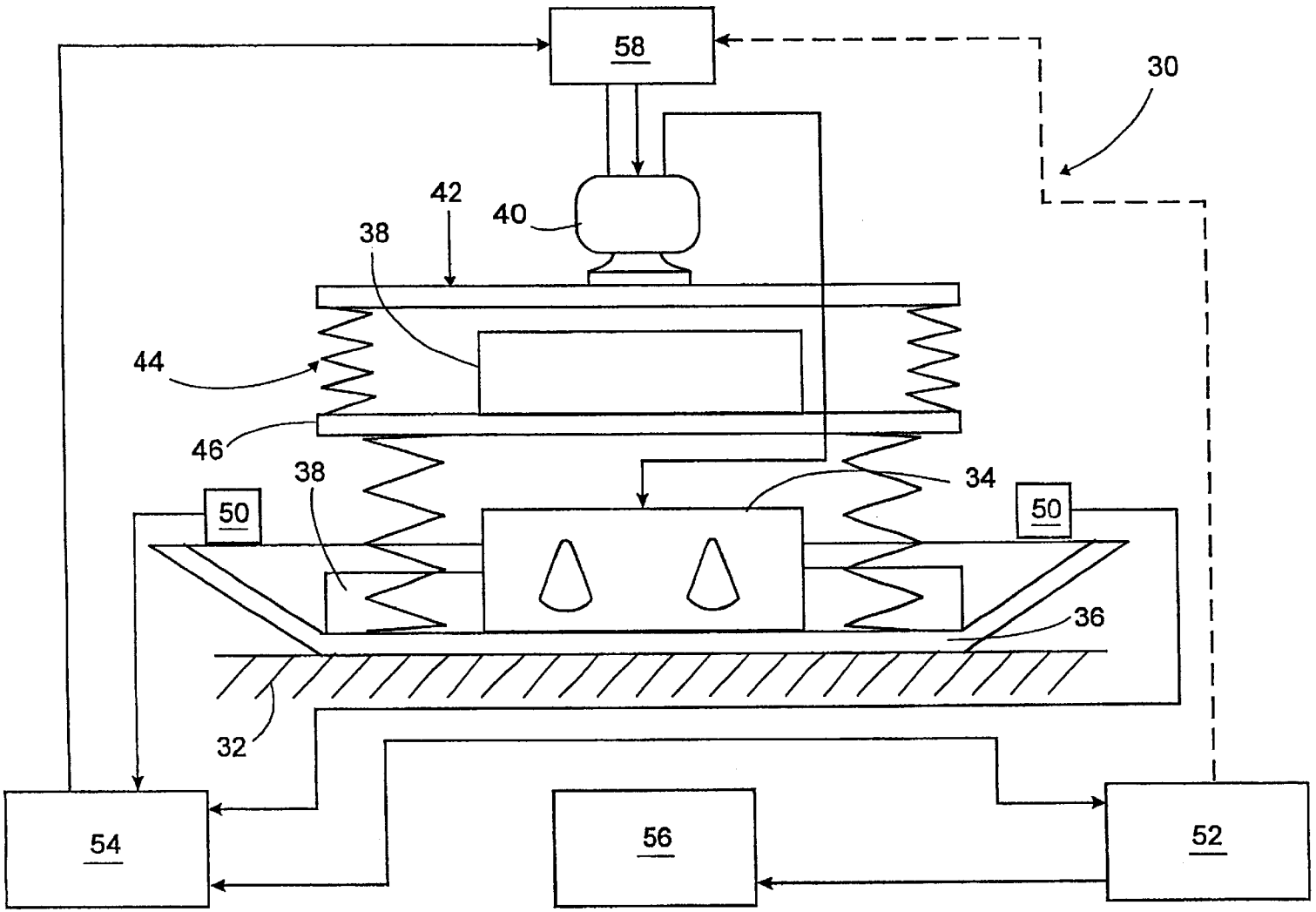
FIG. 4 schematically shows an embodiment of a compacting machine adapted to be controlled according to the invention.

FIG. 4 illustrates a vibratory compaction machine 30 being part of a semi-automatic system for optimal soil compaction. The machine 30 is positioned on a soil base 32 and comprises a working vibrating member 34 placed on a working plate 36 which is provided with optional interchangeable weights 38 for regulation of amplitude, static pressure, and dynamic pressure of the machine. Frequency of vibrations ω of the working member 34 is controlled by a regulator 40 resting on a plate 42. The plate 42 is protected from vibrations by springs 44; the springs 44 support the plate 42 above a plate 46 which is itself carried by springs 48 secured to the working plate 36. The machine is provided with accelerometers 50 (i.e. detectors of frequency, amplitude, acceleration or the related values) which are connected to a computer 52 via interface 54. The computer is capable of obtaining and processing initial and current information on the soil properties according to the inventive method, and is adapted to produce recommended sets of parameters A, ω, S, D, etc. and regimes T on a display 56. According to the recommended parameters, an operator (with or without the aid of the interface 54 and a commander module 58) adjusts the weight, frequency and amplitude of the compaction machine and performs the compaction in agreement with the optimal regime.

The present invention further includes a method for evaluating the compaction of a preselected soil layer, for which a predetermined degree of compaction is desired, at a preselected depth l in a soil base having at least one layer disposed between an exterior upper surface and a hard bottom layer. The compaction is achieved by means of a vibrator compaction device having mass $M_{vib}$ and a bearing area F, thereby defining, with the soil base, a vibrator-soil-base system for modeling and calculation as discussed hereinabove. The method includes the following steps:

evaluating the desired volumetric mass $\gamma_{st}$ of the preselected soil layer corresponding to the desired degree of compaction;

calculating the mass per unit area $m_{soil}$ of the preselected soil layer as a function of the desired volumetric mass, using the formula:

$$m_{soil}=\gamma_{st}*l;$$

calculating the effective vibrating mass M of the vibrator-soil-base system as a function of the mass per unit area of the preselected soil layer and the mass of the vibrator, using the formula:

$$M=M_{vib}+\tfrac{1}{3}(m_{soil}*F);$$

determining the natural oscillation frequency $\omega_o$ of the vibrator-soil-base system when the preselected soil layer is at the desired degree of compaction as a function of its effective mass, using the formula:

$$\omega_o=\sqrt{(C/M)}$$

wherein C is the stiffness coefficient of the soil of the preselected soil layer;

measuring the forced oscillation frequency $\omega_{res}$ of the vibrator-soil-base system for frequencies close to the natural oscillation frequency $\omega_o$;

deriving the volumetric mass $\gamma$ in field conditions of the preselected soil layer as a function of the desired volumetric mass of the preselected soil layer and of the natural oscillation frequency and the forced oscillation frequency of the vibrator-soil-base system, using the formula:

$$\gamma=\gamma_{st}*(\omega_{res}/\omega_o)^2;\text{ and}$$

determining compaction degree K of the compacted preselected soil layer.

The step of evaluating the desired volumetric mass may be performed by measurement on samples compacted to the desired degree under laboratory conditions or by measurement taken in situ on actual soil layers suitably compacted. Alternatively, the desired volumetric mass may be evaluated by calculation from standard soil data.

In the step of calculating the effective vibrating mass of the vibrator-soil-base system, the factor "$\tfrac{1}{3}(m_{soil}*F)$" is the effective portion of the soil base participating in the oscillations of the vibrator-soil-base system. In the step of determining the natural oscillation frequency, the stiffness coefficient of the soil, C, may be experimentally determined; or it may be calculated as a function of the elastic modulus of the soil, E, using the formula:

$$C=E*F/l.$$

The step of determining the compaction degree K of the compacted preselected soil layer may be performed using the formula:

$$K=\gamma/\gamma_{st};$$

or alternatively, if suitable measurements have been taken and the required parameters are known, using the formula:

$$K=(\omega_{res}/\omega_o)^2.$$

The method and mathematical model described hereinabove, may also be applied to evaluate the quality of building structures wherein the frequency response characteristics of a structure to mechanical or other excitations are measured and compared to those of measured, tested, or idealized reference structures.

It will further be appreciated by persons skilled in the art that the scope of the present invention is not limited by what has been specifically shown and described hereinabove, merely by way of example. Rather, the scope of the present invention is defined solely by the claims, which follow.

What is claimed is:

1. A method for evaluating the compaction, by means of a vibrator compaction device having mass $M_{vib}$ and a bearing area F, of a preselected soil layer, for which a predetermined degree of compaction is desired, at a preselected depth l in a soil base having at least one layer disposed between an exterior upper surface and a hard bottom layer, thereby defining a vibrator-soil-base system, said method including the steps of:

evaluating a desired volumetric mass $\gamma_{st}$ of the preselected soil layer corresponding to the desired degree of compaction;

calculating a mass per unit area $m_{soil}$ of the preselected soil layer as a function of the desired volumetric mass;

calculating the effective vibrating mass M of the vibrator-soil-base system as a function of the mass per unit area of the preselected soil layer and the mass of the vibrator;

determining the natural oscillation frequency $\omega_o$ of the vibrator-soil-base system when the preselected soil layer is at the desired degree of compaction as a function of its effective mass;

measuring the forced oscillation frequency $\omega_{res}$ of the vibrator-soil-base system within a preselected frequency range of the natural oscillation frequency $\omega_o$;

deriving the volumetric mass $\gamma$ of the preselected soil layer as a function of the desired volumetric mass of the preselected soil layer and of the natural oscillation frequency and the forced oscillation frequency of the vibrator-soil-base system; and determining compaction degree K of the compacted preselected soil layer.

2. A method for evaluating the compaction according to claim 1 wherein said step of evaluating the volumetric mass is measuring the volumetric mass of a sample of the soil of the preselected soil layer compacted to the desired degree of compaction.

3. A method for evaluating the compaction according to claim 1 wherein said step of evaluating the volumetric mass is performed by calculation using standard soil data.

4. A method for evaluating the compaction according to claim 1 wherein said step of calculating a mass per unit area uses the formula:

$$m_{soil}=\gamma_{st}*l.$$

5. A method for evaluating the compaction according to claim 1 wherein said step of calculating the effective vibrating mass uses the formula:

$$M=M_{vib}+\tfrac{1}{3}(m_{soil}*F).$$

6. A method for evaluating the compaction according to claim 1 wherein said step of determining the natural oscillation frequency uses the formula:

$$\omega_o=\sqrt{(C/M)}$$

wherein C is the stiffness coefficient of the soil of the preselected soil layer.

7. A method for evaluating the compaction according to claim 1 wherein said step of deriving the volumetric mass uses the formula:

$$\gamma=\gamma_{st}*(\omega_{res}/\omega_o)^2.$$

8. A method for evaluating the compaction according to claim 1 wherein said step of determining compaction degree uses the formula:

$$K=\gamma/\gamma_{st}.$$

9. A method for evaluating the compaction according to claim 1 wherein said step of determining compaction degree uses the formula:

$$K=(\omega_{res}/\omega_o)^2.$$

* * * * *